US007293891B2

(12) United States Patent
Herold

(10) Patent No.: US 7,293,891 B2
(45) Date of Patent: Nov. 13, 2007

(54) LIGHTING DEVICE HAVING A LIGHT TUBE WITH MAGNETICALLY ADJUSTABLE ILLUMINATION

(75) Inventor: Michael A. Herold, Akron, OH (US)

(73) Assignee: Herold Design Group LLC, Akron, OH (US)

( * ) Notice: Subject to any disclaimer, the term of this patent is extended or adjusted under 35 U.S.C. 154(b) by 292 days.

(21) Appl. No.: 11/124,467

(22) Filed: May 5, 2005

(65) Prior Publication Data

US 2006/0250798 A1 Nov. 9, 2006

(51) Int. Cl.
*F21V 33/00* (2006.01)

(52) U.S. Cl. ..... 362/109; 362/157; 362/208; 362/235; 362/277; 362/560; 362/577; 362/800; 446/129; 446/130; 446/131; 446/132

(58) Field of Classification Search ..... 362/109, 362/157, 208, 235, 277, 297, 398, 560, 577, 362/800; 446/129–132
See application file for complete search history.

(56) References Cited

U.S. PATENT DOCUMENTS 5,233,679 A 8/1993 Oyama
5,865,524 A 2/1999 Campman
5,980,063 A 11/1999 Ford et al.
6,149,285 A 11/2000 Cicarelli
6,183,108 B1 2/2001 Herold
6,213,626 B1 4/2001 Qian
6,231,207 B1 5/2001 Kennedy et al.
6,337,946 B1 1/2002 McGaffigan
6,371,625 B2 4/2002 Campman
6,527,419 B1 3/2003 Galli
6,726,350 B1 4/2004 Herold
6,758,588 B2 7/2004 Hsu

*Primary Examiner*—Stephen F. Husar
*Assistant Examiner*—Meghan K. Dunwiddie
(74) *Attorney, Agent, or Firm*—Renner, Kenner, Greive, Bobak, Taylor & Weber

(57) ABSTRACT

A lighting device (10) has an elongated light tube (12) to be used in combination with a holster (80) in a manner which will enable the holster (80) to hold the lighting device (10) as may be necessary and also enable the holster (80) to adjust the extent of illumination of the light tube (12) of the lighting device by light received from a light source (24) disposed within the lighting device (10) using magnets (66, 96).

20 Claims, 3 Drawing Sheets

LIGHTING DEVICE HAVING A LIGHT TUBE WITH MAGNETICALLY ADJUSTABLE ILLUMINATION

TECHNICAL FIELD

The present invention relates to a gasless lighting device, and more particularly, to a lighting device of the type having an elongated light tube illuminated by a powered light source positioned at one end of the light tube. Specifically, the present invention relates to a lighting device wherein the extent to which the light tube is illuminated is adjustable and, more specifically, is magnetically adjustable.

BACKGROUND OF THE INVENTION

Battery-operated, gasless lighting devices, such as flashlights, are commonplace throughout the world and well know in the lighting art. More recently, gasless lighting devices of the type having at least an elongated light tube for generally directing light through the tube from at least one end thereof have become popular in the automotive industry as well as the decorative lighting, novelty item and toy industries. The popularity of these lighting devices with elongated light tubes is believed to be based, at least in part, on the recent ability of these light tubes to simulate the characteristics of neon lighting.

"Neon lighting" or "neon light" generally refers to the use of an inert gas, such as neon, that is placed in a clear glass tube and ionized by electrical means such that the electrons in the neon or other gases are charged to provide a unique type of bright, almost fluorescent-like, glowing light. Of course, gases other than neon gas can be used to create different colors for this type of lighting, but neon is the most commonly known gas, and hence, this type of lighting is commonly called "neon lighting." Neon lighting is particularly desirable for its bright glow, thereby allowing objects to be effectively illuminated in the daylight as well as in the dark.

Unfortunately, neon lighting has some drawbacks. In order to use neon lighting, neon or other inert gases must first be inserted into the tube for use. This may not only be costly, but can also be somewhat dangerous if not performed properly. Once the neon gas is properly introduced into the tube, an electrical transformer or battery must be used to apply and maintain a relatively high voltage to the neon gas so as to ionize the gas. The gas, in turn, will glow within and illuminate the tube.

Because the tubes in which the inert gas is held are made of glass, such tubes are often considered fragile and easily breakable. This presents still another danger to the user of neon lighting, and therefore, neon lighting devices are not recommended as toys for children. In addition, when compared to other types of lighting, neon lighting is quite expensive, especially when the neon lighting is made into a custom design. Thus, when these drawbacks, as well as others, are taken into consideration, many people choose to use other more conventional types of lighting, even though a neon light would result in superior lighting with respect to brightness.

Attempts have been made in the prior art to mimic or simulate neon lighting with conventional light sources. Initial efforts focused on the use of a transparent tube having an external sleeve of smooth, flexible transparent plastic material fitted over the tube to aid in projecting, refracting, or reflecting light from a light source located in one end of the tube. Other efforts used various types of mirrors and lenses to project, refract, or reflect light. While some of these efforts have been partially successful, the results have often been achieved through more difficulty, complexity and expense than actual neon. Furthermore, some of these efforts failed to produce a substantially uniform distribution of light along the entire length of the tube.

Recently, the art has been advanced with the invention of simulated neon light tube assemblies like those set forth and disclosed in U.S. Pat. No. 6,726,350, U.S. application Ser. No. 10/792,249, currently pending, and U.S. application Ser. No. 11/124,466, entitled "Interchangeable Simulated Neon Light Tube Assemblies and Related Accessories for Use with Lighting Devices", filed on even date. Those patent and applications, the entirety of the disclosures of all of which are incorporated herein by reference, generally disclose simulated neon light tube assemblies comprising at least a transparent tube and a light-diffusing material rolled or layered within the transparent tube that provides the neon light-like effect to the tube. A light source may be disposed at at least one end of the transparent tube to illuminate it, and a power source may be operatively connected to the light source. Although the light-diffusing material may be optionally used in the present invention described herein, it is these types of light tube assemblies to which the present invention is generally directed. Currently, these simulated neon light tube assemblies may replace certain neon lighting devices, such as illuminated license plate covers and running boards in the automotive industry, and have developed new markets in the toy and novelty item industry. With the popularity of the "Star Wars" movies, new "light sabers" or "light swords" have emerged.

SUMMARY OF THE INVENTION

The present invention provides for a lighting device having an elongated light tube to be used in combination with a holster in a manner which will enable the holster to hold the lighting device as may be necessary and also enable the holster to adjust the extent of illumination of the light tube of the lighting device by light received from a light source disposed within the lighting device. To that end, the lighting device includes a handle portion; a light source disposed within the handle portion; and an elongated light tube having one end attached to the handle portion and capable of being illuminated by light from the light source. The light tube includes a capsule encased within the light tube capable of blocking light from the light source and capable of sliding from one end of the light tube to the other. The capsule further contains at least one magnet aligned to be attracted to other magnets. The holster includes a ring for receiving at least a portion of the light tube of the lighting device and has at least one magnet aligned in the ring to attract the at least one magnet in the capsule. Hence, movement of the light tube through the ring slidably moves the capsule through the light tube, thereby adjusting the extent of illumination of the light tube by light from the light source.

One or more objects and advantages of the present invention will become apparent from the subsequent detailed description of the preferred embodiment and the appended claims taken in conjunction with the accompanying drawings.

PREFERRED EMBODIMENT FOR CARRYING OUT THE INVENTION

Figure 1:
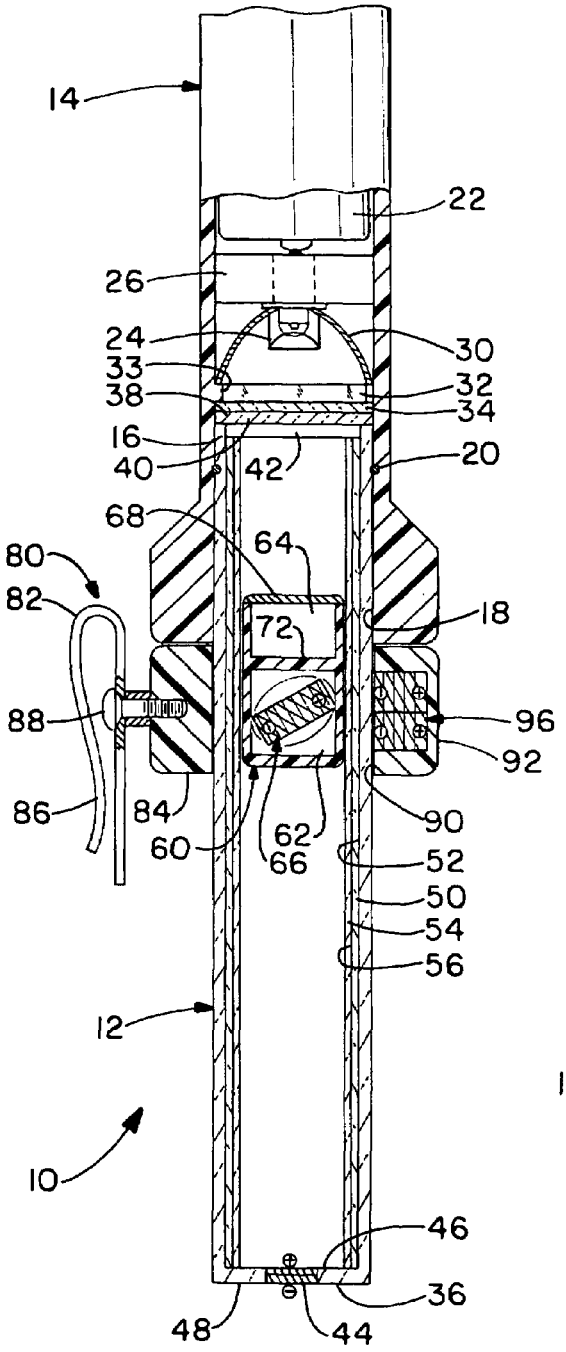
FIG. 1 is a mostly cross-sectional view of a portion of a lighting device of the type having a light tube in accordance with the concepts of the present invention, with the light tube received within a magnetic holster so that light does not illuminate the light tube.

A lighting device embodying the concepts of the present invention is generally designated by the numeral 10 in the drawings. The lighting device 10 is of the type having an elongated light tube 12 attached to a handle portion 14. In the embodiment shown, one end 16 of the light tube 12 is received within a tube-receiving end 18 of the handle portion 14 and may be removably or irremovably affixed to the handle portion 14 by any means known in the art such as, for example, by frictional fit with an O-ring 20 as shown in FIG. 1. Alternative embodiments where the light tube 12 is removable from the handle portion 14 provide for screwing the light tube 12 into the handle portion 14 or vice versa, for sliding the tube into the handle via frictional fit but without use of an O-ring and with or without a set screw, or for placing an retaining cap (not shown) over the entire tube such that the retaining cap is attached to the handle portion 14 and maintains the light tube 12 in place. Irremovable embodiments include sealing the light tube into the tube receiving end 18 of the handle portion 14 with adhesive or other permanent fastening means, or making the light tube and handle portion a one-piece part. In any event, the handle portion 14 should be designed so as to have a dimension sufficient to support and stabilize the light tube 12 during operation of the lighting device 10.

The handle portion 14 may be hollow to allow for the incorporation of a power source 22 such as, for example, a battery or batteries, and a light source 24 such as, for example, a light bulb or a light emitting diode (LED), into one or more compartments of the handle portion 14. Other components used for the production of light for illuminating the light tube 12 may also be included within the handle portion 14, including, for example, a heat sink 26 for radiating heat away from certain components in the handle portion 14.

Figure 3:
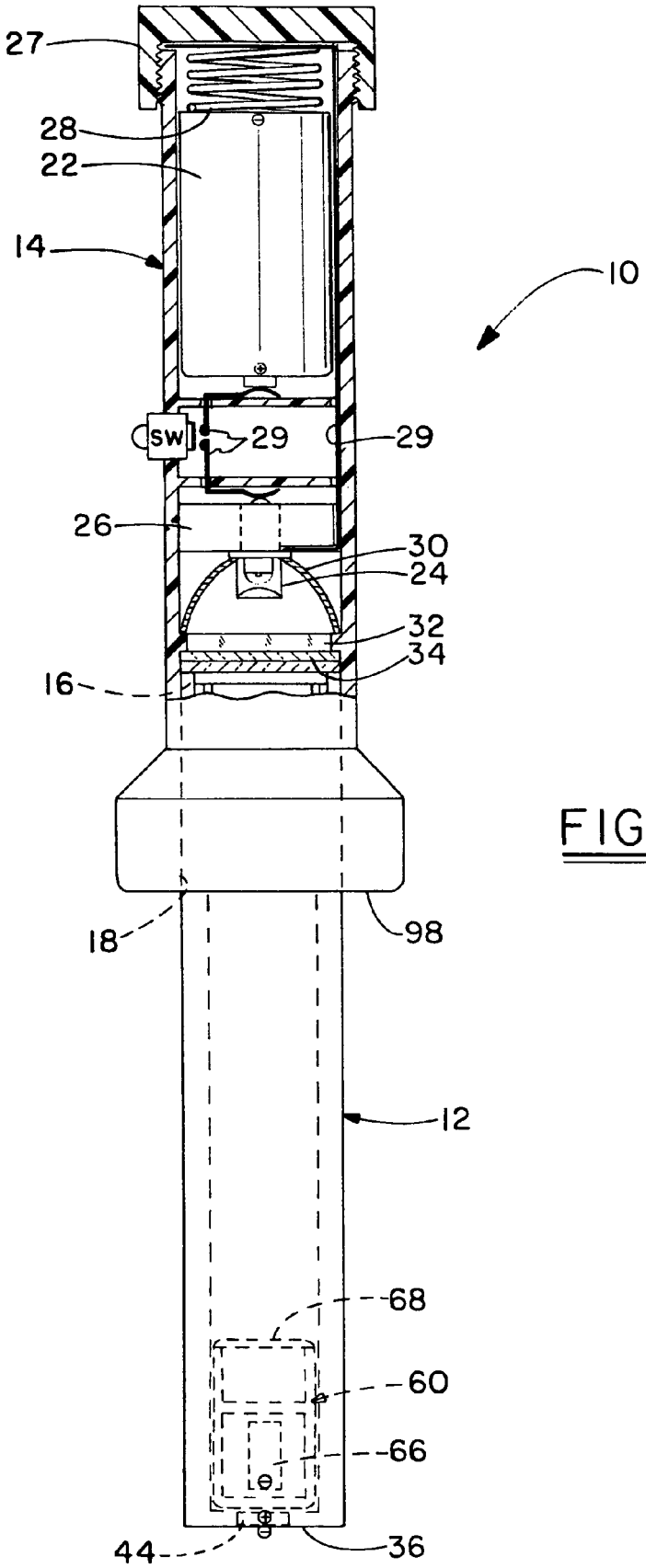
FIG. 3 is a partial cross-sectional view of the handle portion of the lighting device according to the concepts of the present invention with the components of the light tube shown in phantom.

Access to the components within the handle portion 14 may be attained by any means known in the art, including for example a threaded screw cap 27 with spring 28 for holding the power source 22 in place as shown in FIG. 3. Spring 28 would essentially be used to retain the power source 22 in positive electrical engagement with the electrical circuit provided by the spring 28 and a switch SW. Another means of access to the power source 22 and other components within the handle portion 14 includes, but is not limited to, the use of a compartment door (not shown) made a part of the side wall of the handle portion. Essentially, any known method for accessing the compartments inside the handle portion that do not interfere with the function of the lighting device can be used.

The power source 22 is operatively connected to the light source 24 by any means known in the art so as to effectuate the lighting of the lighting device 10. In the embodiment shown in FIG. 3, the light source 24 is connected to the power source 22 via a switch, designated SW, to open or close the power circuit to the light source 24 for illuminating or de-illuminating the light tube 12, respectively. Essentially any type of switch SW can be used for the present invention. In the embodiment shown in FIG. 3, the switch SW is of a push button type with wires 29 connecting the power source 22 to the light source 24, but should not be limited thereto. There may be more than one switch if necessary and desired to allow the user to have greater interaction with the lighting device. Moreover, the switch SW could be internal or external of the handle portion 14 and include mechanisms well known in the art that would allow it to perform electronic operations other than on-off operations for the light source 24.

Alternative embodiments of the present invention also allow for alternate power sources to be located outside of the handle portion 14 and to communicate with the light source 24 via means of a power cord, a rechargeable adapter, a plug (all not shown) and/or other means for connecting the light source 24 to an outside power source. Still other embodiments would permit direct contact between the power source 22 and the light source 24, as generally shown in FIG. 1. The power source 22 should, however, provide sufficient power to the lighting device to enable it to illuminate the light tube as desired for a significant period of time. The power source 22 may also be used to provide power to any other electronic mechanisms that may be incorporated into the lighting device such as, for example, sound devices (not shown).

Essentially any light source 24 suitable for providing light to and capable of emitting enough light to illuminate the light tube 12 may be used in the present invention. For example, one or more light emitting diodes (LEDs) can be used and may be held in place by any means known in the art, including by the metal heat sink 26. If an LED is used, it is preferably the high power type. One advantage of the use of LEDs is that LEDs can emit colored light, thereby providing colored light to the light tube, without the use of a color filter or other means for changing the color of the light emitted. Furthermore, more than one LED can be used to emit multiple colors of light. To that end, the switch SW can be adapted to select the desired color of light to be emitted. For example, where one blue LED and one red LED is employed, the switch can be operated to select either the blue one, thereby producing a blue color in the light tube, or the red one, thereby producing a red color in the light tube, or both, thereby producing a purple color in the light tube.

Alternatively, one or more light bulbs can be used. It is envisioned that essentially any light bulb or light source, including, for example, incandescent bulbs, halogen bulbs, and xenon flash tubes, can be used. When these bulbs and tubes, as well as LEDs are used however, it is preferable to include a lens such as collimating lens 30 for gathering and focusing the light in a controlled direction. A reflective coating or other type of reflector may optionally be used on the collimating lens 30 to make the lens more efficient in redirecting light that may be reflected or refracted back towards the light source and the lens.

The light source 24 and collimating lens 30 may be separated from the light tube in some manner so that the light tube does not push on or contact the light source or lens directly and/or so that water or debris does not contact the light source 24. Advantageously, the handle portion 14 containing the power source 22 and light source 24 could be made water-proof. The present embodiment shown in FIGS. 1 and 3 depicts a divider 32 that may be molded or otherwise securely affixed into place between the lens 30 and the light tube 12. Divider 32 preferably is made of a clear, transparent material such as clear plastic or polymeric material and covers the entire circumferential cross-sectional area of the handle portion between the lens 30 and the light tube 12 in order to maintain a water proof light source compartment. The divider 32 may be flat or have a lens shape to it in order to focus the light through the light tube 12. Alternatively, if a water proof divider is not necessary, the divider 32 may simply be part of a ridge 33 around the periphery of the lens 30 to prevent contact between the light tube 12 and the lens 30. Of course, yet another alternative embodiment would have no divider at all.

Where needed or desired, a color filter 34 may be used to illuminate the emitted light from the light source at a particular wavelength or color for illumination within the light tube 12. Such a color filter 34 is shown in FIGS. 1 and 3 as positioned between the divider 32 and light tube 12. It will thus be appreciated that, in one embodiment, the color filter 34 may be attached to the end 16 of the light tube 12 for placement in the handle portion 14. Alternatively, it may be a separate piece to be placed into the tube receiving end 18 of the handle portion 14 prior to attachment of the light tube 12 to the handle portion 14. The color filter 34 may be permanently affixed to the divider 32 or to the light tube 12, if necessary, by any means known in the art, including via the use of an adhesive. The color filter 34, like the divider 32, should be translucent to allow light through it to the light tube 12, thereby providing the light tube 12 with the desired light. Also, like the divider, it may be flat or have a lens shape for focusing the light through the light tube 12.

As stated above, the light tube 12 may be selectively removable from the handle portion 14 of the lighting device 10, or may be irremovably affixed within the handle portion 14, depending upon the application and desired function of the light tube 12. In the preferred embodiment shown, the light tube 12 is selectively removable as by frictional fit to the handle portion 14 using O-ring 20. As such, the light tube 12 is an elongated tube of clear plastic or other translucent, suitably rigid material capable of illumination upon operation of the light source 24. However, it is alternatively envisioned that the light tube 12 may have fluorescent dyes added to the plastic or polymeric material to provide added color, if desired. Furthermore, the light tube 12 may have two-dimensional or three-dimensional visible indicia molded on either the inner or outer surfaces of the tube. As shown, the light tube 12 is cylindrical in shape and is, therefore, circular in cross-sectional configuration. However, the light tube may take any cross-sectional configuration known in the art and should not necessarily be limited to the shape shown in the drawings.

Being elongated, the light tube 12 has two ends 16, 36, one (16) of which is selectively attached to the handle portion 14 as described previously, and the other (36) of which extends away from the handle portion 14 and light source 24, and is closed or capped for reasons set forth below. The end (16) proximate the handle portion 14 and/or the light source 24 may or may not include a cap 38 on that end of the light tube 12, depending upon how the light tube 12 is attached to the handle portion 14. Where the end is open, the divider 32 or color filter 34, if used, will essentially act and function in the manner described for the cap 38 as set forth herein.

As shown in FIG. 1, the cap 38 is disposed on the end 16 of the light tube 12 and includes a cover 40 and a neck 42 disposed slightly within the light tube 12. It will be appreciated, however, that essentially any cap can be used to close the end of the tube as desired, and such a cap having a cover and neck are not necessarily required for the present invention, even where a cap is employed. Nevertheless, the cap 38 may be molded, fused, ultrasonically welded, sealed, screwed, adhered or otherwise attached to the end 16 of the light tube 12. The cap 38, if used, should be made of a clear or transparent plastic or polymeric material similar to that of the divider 32 or of the light tube itself so as to permit light from the light source 24 to be reflected through it and into the light tube 12. The cap 38, too, may be flat or have a lens shape for focusing the light through the light tube 12. In the particular embodiment shown, the neck 42 of cap 38 advantageously aids in preventing any materials around the inner periphery of the light tube 12 such as, for example, a diffusing film, from sliding within the light tube during use. Moreover, the cap 38 may aid in making the light tube 12 water proof.

Although not shown as such in the present embodiment, the other end 36 of the light tube 12 may also be capped in a manner similar to that set forth with cap 38 in the other end 16 of the tube 12. In the present embodiment shown however, that end 36 is closed as by molding that end of the tube as an integral part of the light tube. Included in the end 36 of the light tube 12 however, is a holding magnet 44 to be used in cooperation with a magnet capsule 60 as described below. The holding magnet 44 may be made integrally a part of the light tube, or separately attached to the end 36 thereof. That is, it is envisioned that the holding magnet 44 may be separately attached to the inside 46 or outside 48 surfaces of end 36 using any fastening means known in the art, including but not limited to adhesive, threaded fit, or frictional fit.

The magnet 44 can be a single magnet or a series of magnets. However, it should not be significantly powerful, as its purpose is only to hold the magnet capsule 60 in place during use of the lighting device 10. Orientation of the positive and negative charges of the magnet 44 in relation to other magnets to be used and described below may be important in some instances. Accordingly, in the preferred embodiment, the holding magnet 44 has its positive magnetic end proximate, and its negative magnetic end distal to the light source 24, although reversal of the charges can coincide with reversal of the below described polarizations of the other magnets used.

Where a simulated neon lighting appearance is desired for the light tube 12, the light tube 12 may include a diffusing film 50 of the type described and disclosed in U.S. Pat. No. 6,726,350, U.S. application Ser. No. 10/792,249, currently pending, and U.S. application Ser. No. 11/124,466, entitled "Interchangeable Simulated Neon Light Tube Assemblies and Related Accessories for Use with Lighting Devices", filed on even date. Generally, this diffusing film 50 may be made of any material suitable for imparting a neon lighting-like effect to the light tube 12 when light is produced from the light source 24, and is preferably a thinly rolled sheet or layered sheets of polished or otherwise reflective and refractive plastic selected from the group consisting of acetate, vinyl, polyethylene, polypropylene, cellophane and polyester. More particularly, the diffusing film 50 may, for example, have a single sheet thickness of from about 0.001 inches to about 0.004 inches that is then rolled, layered, or otherwise disposed against the inner surface 52 of the light tube 12 so as to have a total thickness of from about 0.0031 inches to about 0.375 inches around the inner periphery of the light tube 12, depending upon the material used as the diffusing film. If desired, the diffusing film 50 may also be etched or otherwise have indicia placed thereon for commercial appeal.

Figure 2:
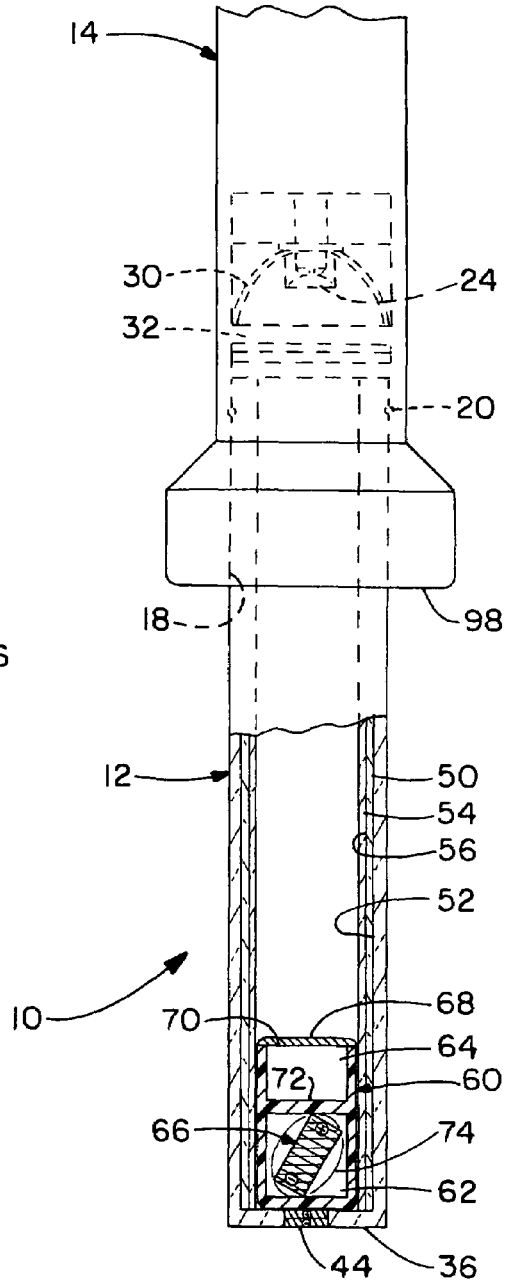
FIG. 2 is a partial elevational view of the portion of the lighting device depicted in FIG. 1, with a portion of the light tube depicted in cross-section, wherein the lighting device has just been removed from the magnetic holster.

As shown in FIGS. 1 and 2, the diffusing film 50 may be inserted into the light tube and positioned against the inner surface 52 of the light tube 12 during manufacturing of the tube 12 by sliding the film 50 into the tube 12 from the end 16 of the light tube 12 prior to capping the tube 12 and/or inserting the tube 12 into the handle portion 14. In the preferred embodiment, the diffusing film 50 extends essentially the entire length of the light tube 12 and encompasses the inner periphery of the light tube 12. Furthermore, as shown, it may be held in place by the neck 42 of the cap 38.

Where a diffusing film 50 is employed within the light tube 12, the light tube 12 may further include an optional liner sleeve 54 to be inserted into the light tube 12 over the inner surface 56 of the diffusing film 50. Such a sleeve would be made of clear, wear resistant plastic or other hard, wear resistant, transparent or translucent polymeric material that would allow for the transmission of light therethrough. Preferably, the liner sleeve 54 would cover the entire length of the diffusing film 50 in order to prevent the diffusing material from getting scratched or contacting the magnet capsule 60.

As noted above, the light tube 12 of the present invention further includes a magnet capsule 60 slidably received therein, preferably within the liner sleeve 54. The magnet capsule 60 may be of any size, shape or dimension known in the art, but should be capable of sliding freely within the light tube 12, and therefore, should preferably have a cross-sectional configuration compatible to that of the light tube 12. Moreover, for reasons that will be understood as set forth below, the magnet capsule 60 should also fully envelope the remaining cross-sectional width or cavity area of the light tube 12.

The magnet capsule 60 may be formed from any suitable material, including but not limited to plastic, glass or other polymeric materials such as, for example, polycarbonate, polystyrene, or polypropylene. Alternatively, it is possible that the magnet capsule 60 may be made entirely from magnetic materials.

The magnet capsule 60 may be generally viewed as having one or more sealed chambers 62, 64, one of the sealed chamber 62 containing one or more, preferably high powered, magnets 66 bundled (if in series) and aligned in a manner so as to provide a positive magnetic charge to one end of the series of magnets 66 and a negative charge to the other end of the series of magnets 66. In the embodiment shown, the series of magnets would have a positive charge at the end proximate to the light source 24 and a negative charge at the end distal to the light source 24. The series of magnets 66 should have enough polarization to effectively polarize the magnet capsule so as to slidably move the magnet capsule 60 from one end of the light tube to the other end, and vice versa, upon magnetic attraction or repulsion with other magnets surrounding the light tube 12. In order to aid the magnet capsule 60 in sliding along the length of the light tube 12 or optional liner sleeve 54, the liner and/or the capsule may be coated with a clear lubricant or with a polymeric coating such as, for example, Teflon. Preferably, however, the lubricant or coating should not interfere with the transmission of light to the diffusing film 50.

In addition to the chambers 62, 64, and the series of magnets 66, the magnet capsule 60 further includes a reflector or reflective coating 68 disposed on the surface 70 of the magnet capsule 60 that is proximate to the light source 24. Such a reflector or reflective coating 68 may be attached to the capsule 60 by any means known in the art, such as, for example, by spraying or painting the reflective coating, or by adhering or fastening the reflector. The reflector or reflective coating 68 is used to reflect light from the light source 24 back into the light tube 12 in the direction of the light source 24 so as to be eventually dispersed through the walls of the light tube 12.

For this reason, additional chamber 64 may be used to extend the length of magnet capsule 60 into the handle portion 14 as may be necessary to block any light from being emitted through the light tube 12 as will be discussed below. An additional chamber 64 with a divider 72 is used to prevent the series of magnets 66 in the first chamber 62 from traveling from one of the end magnet capsule to the other. The purpose of the magnets 66 is to move the capsule from one end of the tube to the other. If no divider 72 were present and the capsule 60 was significantly longer than the series of magnets 66 used in the capsule 60, then the magnets 66 would have the ability to move without moving the capsule 60. Furthermore, it will be understood that the magnets 66 must be at least as long as the inside diameter of the magnet capsule 60 so that they will not rotate completely within the capsule. That is, while the magnets 66 may tilt from an "up and down" position as shown in phantom in FIG. 3 to a slightly less than 90° tilt position as shown in FIG. 1, they will not freely rotate 180 degrees within the capsule 60. It will further be appreciated that the size of the chamber 62 in which the magnets 66 are contained should be compatible to and slightly longer than the length of the magnets 66 themselves to allow the magnets to rotate back and forth from the slightly less than 90° tilt shown in FIG. 1 to the "up and down" position shown in phantom in FIG. 3. Essentially any size magnet suitable for carrying out the purpose of the invention may be used.

If more than one magnet is used and they are in series, the magnets 66 may be bundled in any manner known in the art. For example, they may be a part of an oval-like structure 74 to aid in the rotation of the magnets 66 to or away from the other magnetic forces acting upon them. Alternatively, they may simply be wrapped, or otherwise held together with no additional structure.

As stated previously, the present invention relates to the adjustability of the extent of illumination of the light tube. In order for the magnet capsule 60 to slidably move within the light tube, which thereby adjusts the extent of illumination of the light tube, a magnetic force must act upon the one or more magnets 66 in the magnet capsule 60. In the present invention, a magnetic holster, generally designated by the numeral 80 in FIG. 1, is used to hold the lighting device 10 and to effect the adjustment of the extent of illumination of the light tube 12 as set forth below.

Magnetic holster 80 generally includes a fastener 82 and a magnetic ring 84. The fastener 82 allows the user to attach the magnetic holster 80 to the user's belt, pants, or other desired location. Essentially any fastener or other convenient means for attaching the magnetic ring 84 to a desired location may be used. Various fasteners include, for example, a compression clip, a slide clip, a pinch clip, hook and loop fabric, and the like. It is also envisioned that the holster 80 may be attached to other objects unrelated to the user such as, for example, a wall, counter or other fixture or surface. Suitable fasteners for these surfaces would include, but not be limited to, screws, nails, and adhesives. In the preferred embodiment, the fastener 82 includes a clip 86 suitable for affixing the holster 80 to the user's clothing or belt, and a pin 88 attaching the clip 86 to the magnetic ring 84. The pin 88 may be of the type that is removable from the magnetic ring 84 such that the ring 84 may be used separately and apart from the clip 86. For example, a quick release pin is envisioned that would enable the user to manipulate the magnetic ring 84 over the light tube 12 without the clip 86 being present.

The magnetic ring 84 of holster 80 may be any size or shape known in the art, but should be compatible with the cross-sectional configuration of the light tube of the lighting device 10 employed therewith. To that end, where the light tube 12 is cylindrical in shape, the inner circumference or inner peripheral surface 90 in the magnetic ring 84 should also be cylindrical in shape and be essentially compatible in size to the outer circumference of the light tube 12. In the preferred embodiment, magnetic ring 84 is essentially donut shaped and includes an outer peripheral surface or circumference 92 and an inner peripheral surface or circumference 90, the latter of which defines an opening for slideably receiving the light tube 12 of the lighting device 10.

Magnetic holster 80 can be formed from any suitable material or combination of materials known in the art, including, but not limited to: plastic, polycarbonate, polystyrene, or even some magnetizable material.

The magnetic ring 84 preferably includes one or more high powered magnets 96 bundled (if in series) and aligned in a manner so as to provide a positive magnetic charge to one end of the series of magnets 96 and a negative charge to the other end of the series of magnets 96. In the preferred embodiment shown in FIG. 1, the positively charged end of the magnets 96 is located toward the outer circumference 92 of the magnetic ring 84, and the negatively charged end of the magnets 96 is located toward inner circumference 90 of the magnetic ring 84. There may be one or more series of magnets 96 placed side-by-side or around the inner periphery of the magnetic ring 84 as well. The combined magnetic force of these magnets 96 should be as least as great as or greater than those magnets in the magnet capsule 60 and should be greater than the magnetic force provided by the magnet 44 at the end 36 of the light tube 12.

Given the foregoing, it should now be apparent that the extent of illumination of the light tube 12 of the lighting device 10 of the present invention is magnetically adjustable. In operation, the magnetic holster 80 may be affixed or fastened to a desired location, such as a belt of the user of the lighting device. As shown in FIG. 1, when the light tube 12 of the lighting device 10 is placed into the magnetic holster 80, the magnet capsule 60 is slidably moved toward the handle portion 14 and light source 24 at the same speed at which the light tube 12 is placed into the magnetic holster 80. The magnet capsule 60 continues up the light tube 12 until the magnetic holster 80 stops. In the present embodiment, magnetic holster 80 is stopped when it contacts the base 98 of the handle portion 14 that preferably is rigid and solid enough to prevent the magnetic holster 80 from moving farther towards the light source 24. Once the magnetic holster 80 is stopped, the magnet capsule 60 is stopped. The magnet capsule 60 may or may not be positioned at the end 16 of the light tube 12. However, if it isn't, the magnet capsule 60 should be extended with one or more additional compartments 64 such that the reflector or reflective coating 68 on the end 70 of the magnet capsule 60 proximate the light source 24 extends into the light tube receiving end 18 of the handle portion 14. In this position, it will be appreciated that no light can escaped from within the handle portion 14 and, even though the light source 24 may be emitting light, none of the light is being used to illuminate the light tube 12, the magnet capsule 60 being used to completely block the light from entering the light tube beyond its current position.

On the other hand, when the lighting device 10 is removed from the magnetic holster 80, the magnets 66 in the magnet capsule 60 will follow the magnets 96 in the magnetic holster 80 and slide the magnet capsule 60 down the light tube away from the handle portion 14 and light source 24. Once the magnetic holster 80 is removed completely from the lighting device 10 and is no longer in magnetic contact with the magnet capsule 60, the magnet capsule 60 is positioned at the distal end 36 of the light tube 12. The magnets 66 in the magnet capsule 60 are now attracted to and magnetically engaged to the magnet 44 disposed at the end 36 of the light tube 12. Magnet 44 should have enough magnetic force and attraction to the magnets 66 in the capsule 60 to maintain the magnet capsule 60 engaged to the end 36 of the light tube 12 during all use of the lighting device 10 away from magnetic holster 80.

Thus, in the present invention, the position of the magnet capsule 60 within the light tube 12 determines the distance that the light, from the light source 24, can travel through the light tube 12 to illuminate it. For example, when the magnet capsule 60 is disposed at the end 36 of the light tube 12, the light from the light source 24 is permitted to travel the entire length of the light tube 12 fully illuminating it, except for that de minimus portion of the tube containing the magnet capsule 60. Where appropriate light diffusing film has been used, the light tube will appear to have a simulated neon lighting effect.

Once the user is through using the lighting device 10, the user may place the lighting device 10, light tube 12 first, back into the magnetic holster 80. Again, the magnets 66 in the magnet capsule 60 will be more forcefully attracted to the more powerful magnets 96 in the magnetic holster 80 than the magnet 44 such that the magnet capsule 60 will be magnetically disengaged from the magnet 44 and will follow the magnets 96 in the holster 80 up the light tube 12 until the holster 80 is again stopped by base 98.

Figure 4:
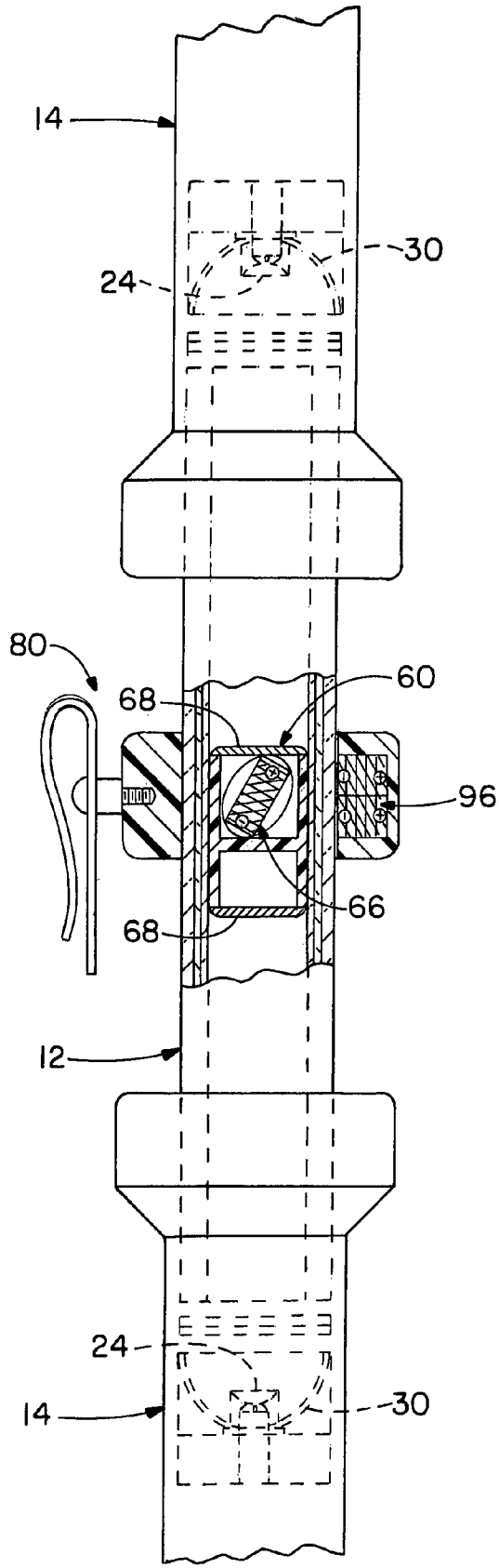
FIG. 4 is a partially cross-sectional view of an alternative embodiment of a lighting device of the type having a light tube in accordance with the concepts of the present invention, wherein light is emitted from two handles.

In an alternative embodiment of the present invention, it is envisioned that the lighting device 10 can be used with or without the holster 80, that the magnet 44 at the previously closed end 36 of light tube 12 can be replaced with a translucent or transparent cap substantially the same as the cap 38 at the other end 16 of the tube 12 described for use in operative connection with the handle portion 14, that an additional handle portion 14, as shown in FIG. 4, like the one described and including a light source (and, optionally, a power source) therein, can be added to receive that end 36 of the light tube 12, whereby this new light source would also be capable of emitting light and illuminating the tube 12, and that the magnet capsule 60 would further include a reflector, such as 68, on its end extending away from the original light source and proximate this new light source 24 such that light emitted from this new light source 24 would be reflected back by this new reflector 68. Given that no magnets would necessarily be used to attract the capsule (although they could still be used), the user could manipulate the capsule 60 in a manner such that it would travel up and down the light tube according to the desires and manipulations of the user. The light from the light sources 24 could be different colors (where, for example, LEDs are used), and illuminate the tube as desired, with the capsule 60 blocking and reflecting light from each light source. These substitute components could be snapped on or retro-fitted based upon the desires of the manufacturer.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms that may come within the language and scope of the attached claims.

The invention claimed is:

1. A combination lighting device and holster for holding the lighting device, wherein said lighting device comprises a handle portion;

a light source disposed within said handle portion for emitting light;

an elongated light tube having one end attached to said handle portion and capable of being illuminated by light from said light source, said light tube including a capsule encased within said light tube capable of blocking light from said light source and capable of sliding from one end of said light tube to the other, said capsule containing at least one magnet aligned to be attracted to other magnets; and wherein the holster comprises a ring for receiving at least a portion of said light tube of said lighting device and having at least one magnet aligned in said ring to attract the at least one magnet in said capsule, whereby movement of said light tube through said ring slidably moves said capsule through said light tube, thereby adjusting the extent of illumination of said light tube by light from said light source.

2. The combination as set forth in claim 1, wherein said lighting device further includes a power source disposed in said handle portion, said power source being operative connected to said light source.

3. The combination as set forth in claim 1, wherein said light source is comprised of at least one of an incandescent light bulb, a halogen light bulb, a xenon flash tube, and a light emitting diode.

4. The combination as set forth in claim 1, wherein said elongated light tube further includes a light diffusing film disposed against an inner surface of said light tube.

5. The combination as set forth in claim 4, wherein said elongated light tube further includes a liner sleeve disposed against an inner surface of said light diffusing film.

6. The combination as set forth in claim 1, wherein said end of said light tube attached to said handle portion is frictionally fit into a tube-receiving end of said handle with an O-ring.

7. The combination as set forth in claim 1, wherein said end of light tube attached to said handle portion is closed with a transparent cap.

8. The combination as set forth in claim 1, wherein said end of said light tube attached to said handle portion is open.

9. The combination as set forth in claim 1, wherein said lighting device further includes a color filter disposed between said light source and said light tube.

10. The combination as set forth in claim 1, wherein said capsule includes a compartment for said at least one magnet and a separate compartment without a magnet extending toward said light source.

11. The combination as set forth in claim 1, wherein said capsule includes a reflector on an end of said capsule proximate to said light source for reflecting light.

12. The combination as set forth in claim 11, wherein said reflector is a reflective coating on said end of said capsule.

13. The combination as set forth in claim 1, wherein said light tube further comprises a magnet disposed and aligned at the distal end of said light tube so as to attract the at least one magnet in said capsule, whereby slidable movement of said capsule is prevented within said light tube when said magnet in said capsule is magnetically attracted to and engaged with said magnet disposed at the distal end of said light tube.

14. The combination as set forth in claim 13, wherein said at least one magnet in said ring is magnetically more powerful than said magnet disposed at the distal end of said light tube, such that movement of said light tube through said ring magnetically disengages said at least one magnet in said capsule from said magnet at the distal end of said tube in order magnetically follow said at least one magnet in said ring.

15. The combination as set forth in claim 1, wherein said capsule blocks any light emitted from said light source when said handle portion of said lighting device contacts said holster.

16. The combination as set forth in claim 1, wherein said holster further comprises a fastener operatively connected to said ring.

17. The combination as set forth in claim 15, wherein said fastener is selected from the group consisting of a compression clip, a slide clip, a pinch clip, and hook and loop fabric.

18. The combination as set forth in claim 16, wherein said fastener is operatively connected to said ring by a pin.

19. The combination as set forth in claim 1, wherein said ring of said holster has an inner peripheral surface that is compatible to the cross-sectional configuration of the light tube.

20. A lighting device comprising two handle portions;

a light source disposed within each said handle portion for emitting light; and an elongated light tube having one end attached to one of said handle portions and capable of being illuminated by light from said light source within that handle portion and having another end attached to the other of said handle portions and capable of being illuminated by light from said light source within that handle portion, said light tube including a capsule encased within said light tube and having a reflector on each end, the capsule being capable of blocking light from said light sources and slidable from one end of said light tube to the other.

* * * * *